US006822632B2

(12) United States Patent
Lee et al.

(10) Patent No.: US 6,822,632 B2
(45) Date of Patent: Nov. 23, 2004

(54) LIQUID CRYSTAL DISPLAY DEVICE

(75) Inventors: Gyu-Su Lee, Suwon-si (KR); Jin-Ho Park, Suwon-si (KR); Yong-Eun Park, Seongnam-si (KR); Nam-Soo Kang, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 290 days.

(21) Appl. No.: 09/911,084

(22) Filed: Jul. 24, 2001

(65) Prior Publication Data

US 2002/0024484 A1 Feb. 28, 2002

(51) Int. Cl.[7] ..... G09G 3/36
(52) U.S. Cl. ..... 345/95; 345/87
(58) Field of Search ..... 345/87–100

(56) References Cited

U.S. PATENT DOCUMENTS 5,283,477 A * 2/1994 Shibata ..... 327/306
5,537,129 A * 7/1996 Okada et al. ..... 345/90
5,764,210 A * 6/1998 Moon ..... 345/90
5,798,741 A * 8/1998 Kajihara ..... 345/94
5,831,605 A * 11/1998 Yasui et al. ..... 345/211
5,841,410 A * 11/1998 Oda et al. ..... 345/58
6,229,510 B1 * 5/2001 Kim et al. ..... 345/87
6,300,926 B1 * 10/2001 Yoneya et al. ..... 345/87
6,346,932 B1 * 2/2002 Maeda ..... 345/90
6,392,626 B1 * 5/2002 Moon ..... 345/94
6,529,179 B1 * 3/2003 Hashimoto et al. ..... 345/87
6,567,064 B1 * 5/2003 Song et al. ..... 345/94

* cited by examiner

*Primary Examiner*—Xiao Wu
*Assistant Examiner*—Kevin M. Nguyen
(74) *Attorney, Agent, or Firm*—McGuireWoods LLP

(57) ABSTRACT

Disclosed is a liquid crystal display device comprising a display part. The liquid crystal display device allows a common electrode voltage swinging depending on a gate off voltage of the display part to be fed-back through a feed-back circuit and to be held at a constant level, thus stabilizing the common electrode voltage and the gate off voltage coupled to a capacitance component, thereby preventing a picture displayed on the liquid crystal display panel from being divided into blocks. The common electrode voltage is detected at a position capable of being connected to the common electrode. The detected common electrode voltage is input into a comparator for outputting the common electrode voltage. The output of the comparator is controlled to thereby control the swing of the common electrode voltage.

17 Claims, 7 Drawing Sheets

LIQUID CRYSTAL DISPLAY DEVICE

BACKGROUND OF THE INVENTION

1. Field of the Invention

The present invention relates to a liquid crystal display device (LCD), and more particularly, to an LCD which allows a common electrode voltage swinging depending on a gate off voltage of a display part to be fed-back through a feed-back circuit and to be held at a constant level, thus stabilizing the common electrode voltage and the gate off voltage coupled to a capacitance component, thereby preventing a picture displayed on the LCD panel from being divided into blocks.

2. Description of the Related Art

Generally, an LCD is a mostly used type of flat panel display. Especially, the small size, lighter weight and lower power consumption render the LCD to replace a traditional cathode ray tube (CRT).

The LCD is currently used as a monitor for a portable computer and largely includes an optical module, a display part and a receiving container for containing and fixing these elements.

The display part includes an LCD panel, at least one printed circuit board (PCB) and a tape carrier package (TCP) for physically and electrically connecting the LCD panel and the PCB. The LCD panel includes a TFT substrate, a color filter substrate attached to the TFT substrate, and a liquid crystal layer interposed between the TFT substrate and the color filter substrate. The PCB includes several integrated circuits mounted thereon and interconnection lines for signal transmission. The TCP has a drive integrated circuit (IC) mounted therein.

Technologies in the above constituted display part are being variously developed in order to obtain a large size LCD panel and decrease the volume occupied by the PCB. As one of such technologies, there was filed an application related to an LCD not having the gate PCB in Korean Patent Office by the present assignee as a Korean Patent Application No. 1999-13650.

In this application, a gate drive IC is mounted on the flexible circuit and plural flexible circuits are physically and electrically connected to the TFT substrate with being apart by a constant interval from each other. Here, the interconnection lines for transmitting gate on/off voltages and plural control signals into respective drive ICs are designed to go via an edge of the TFT substrate, and length, area and thickness thereof are designed in such a degree that the signals are not distorted upon considering the resistance of the interconnection lines.

However, when manufacturing the display part of LCDs, especially, the interconnection line which goes via the TFT substrate and the flexible circuit comes to have different resistances depending on a position where the interconnection line arrives at the flexible circuit. Also, the interconnection line is coupled with elements including adjacent interconnection lines to have a capacitance. Accordingly, the gate on and off signals transmitted through the interconnection lines have delay characteristics due to the resistance and capacitance and are input into every gate drive integrated circuit with different amplitudes. This phenomenon is especially highlighted in a case of the gate off voltage.

The gate on/off voltages applied through the interconnection lines does not greatly affect on the common electrode voltage when the display part is driven in a dot inversion method. This is because in a general dot inversion pattern, a large variation of current in the gate off line or common electrode does not occur due to the current compensation effect between adjacent pixels.

However, in a vertical stripe pattern in which a black line and a white line are alternatively displayed between vertical lines which are adjacent in a horizontal direction, such the current compensation effect is minimized.

So, an alternating current coupled with the data line affects on the gate off line and the common electrode, which causes the swing of the gate off voltage and the common electrode voltage.

Finally, due to the resistance difference caused by the length difference of the interconnection lines connected to the gate off line, gate signal has different delay characteristics. Especially, since the gate off voltage is not compensated in the case of the stripe pattern, the gate off voltage swings depending on the swing of the common electrode voltage, so that the common electrode voltage is instabilized. Accordingly, there appears a block phenomenon in which a dim brightness difference is generated at the boundaries of the display region which are divided by separate gate drive ICs.

SUMMARY OF THE INVENTION

It is an object of the present invention to stabilize the gate off voltage applied to an LCD panel of a display part by feeding-back the common electrode voltage and thereby prevent the display region of the display part from being made in a block every gate drive IC.

To accomplish the above object, there is provided a liquid crystal display comprising: an optical module for providing a light necessary to form an image; a display part for displaying the image by controlling a transmittance amount of the light provided from the optical module; and a receiving part for receiving and fixing the optical module and the display part.

In the above LCD, the display part comprises: an LCD panel; a PCB for providing a data signal, a gate on/off signal, a common electrode voltage and first plural control signals to operate the LCD panel; a source signal converting part for generating a source signal with the data signal and a second control signal which is contained in the first plural control signals and applying the source signal to the LCD panel; a gate signal converting part for generating the gate on signal and gate off signal with the gate on/off signal and a third control signal contained in the first plural control signals and applying the gate on signal and gate off signal to the LCD panel; and a gate voltage stabilizing part for detecting the common electrode voltage from at least one position, controlling the common electrode voltage which is output when feeding-back the detected common electrode voltage so as to maintain an amplitude of the gate off voltage at a constant level.

In the above LCD, the gate voltage stabilizing part includes: a first feed-back voltage detecting section for detecting a first feed-back voltage from at least one position to detect the common electrode voltage of the LCD panel; a reference voltage applying section for controlling a static voltage into a predetermined voltage level to input the controlled predetermined voltage level as a reference voltage; a comparator for comparing the first feed-back voltage with the reference voltage to output a result obtained from the comparing; and an output section for dividing the result output from the comparator into at least two voltages having different voltage levels from each other to output the divided voltages as the common voltage of the LCD panel.

Preferably, the comparator includes a loop in which an output is mixed with the first feed-back voltage and then is fed-back to the comparator such that the loop stabilizes an output of the comparator when the first feed-back voltage detecting section is opened.

Preferably, the common electrode voltage is detected at a gate side or a source side.

BRIEF DESCRIPTION OF THE DRAWINGS

The above objects and other advantages of the present invention will become more apparent by describing in detail a preferred embodiment with reference to the attached drawings in which.

DESCRIPTION OF THE PREFERRED EMBODIMENTS

Reference will now be made in detail to the preferred embodiments of the present invention, examples of which are illustrated in the accompanying drawings.

Hereinafter, a liquid crystal display device according to the present invention is described more fully with reference to the accompanying drawings.

Figure 1:
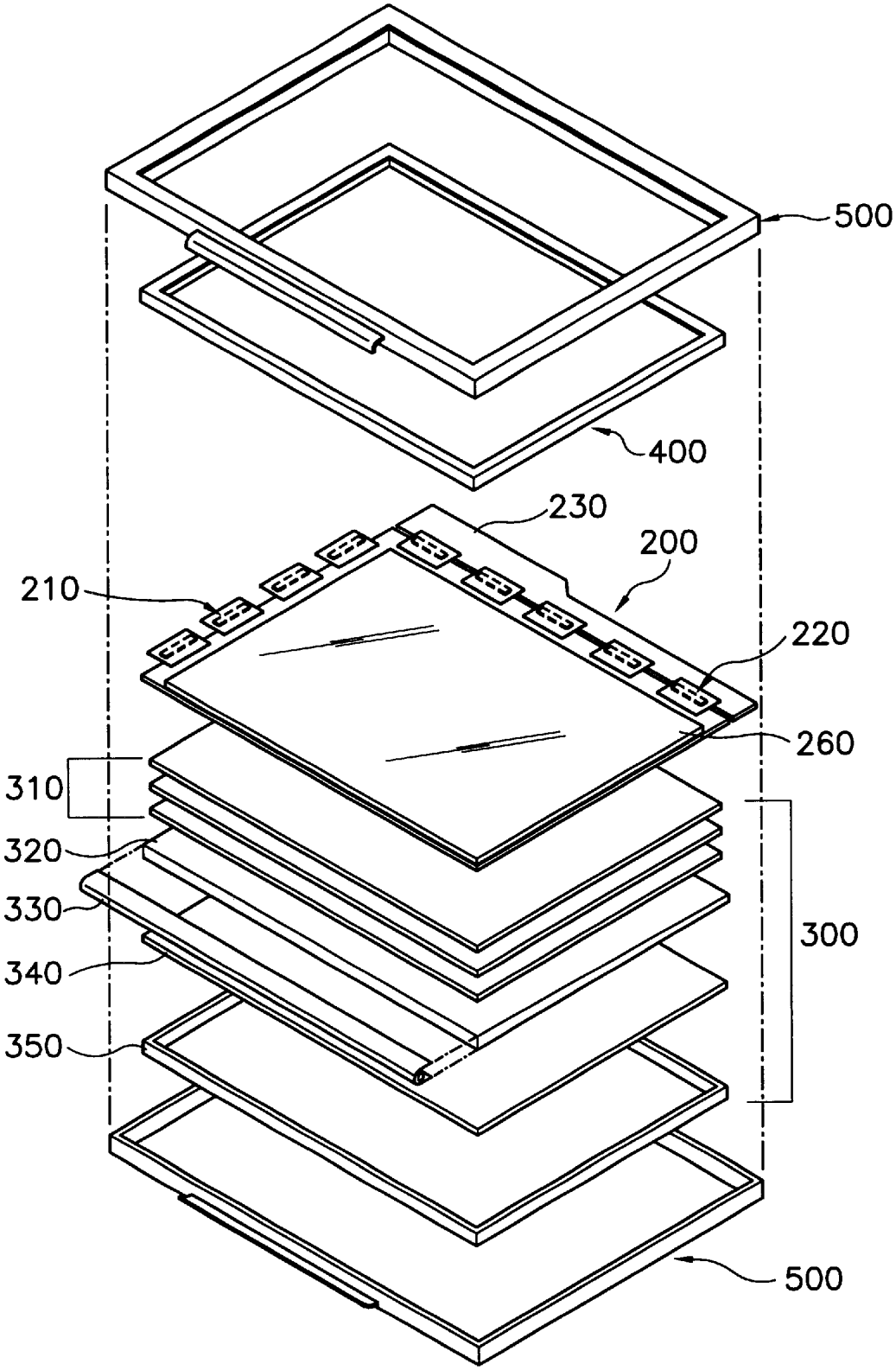
FIG. 1 is an exploded perspective view of a liquid crystal display device according to a preferred embodiment of the present invention.

Referring to FIG. 1, the liquid crystal display device includes a display part 200, an optical module 300 and a receiving part. The receiving part includes a chassis 400 and a cover 500.

The display part will be described later with reference to FIGS. 2 and 3.

The optical module 300 is comprised of optical sheets 310, a light guiding plate 320, a lamp assembly 330, a light reflecting plate 340 and a mold frame 350.

The lamp assembly 330 provides a light emitted from a lamp (not shown) installed therein. The light guiding plate 320 guides the light provided from the lamp assembly 330 arranged near a side portion of the light guiding plate 320. The light reflecting plate 340 functions to reflect the light guided by the light guiding plate 320 upward. The optical sheets 310 controls the light reflected by the light reflecting plate 340 to function as providing a straight progressive property. The aforementioned elements included in the optical module 300 are received inside the mold frame 350.

The display part 200 is mounted on the optical sheets 310 of the optical module 300. Printed circuit board (PCB) 230 to be described later is folded backward and is the assembled at the rear surface of the mold frame 350. Flexible printed circuit (FPC) 210 to be described later is mounted on the sidewall of the mold frame 350.

As aforementioned, the display part 200 and the optical module 300 are assembled together and they are assembled inside the chassis 400 and the cover 500. Here, the cover 500 consist of an upper cover and a lower cover and thus fixes the display part 200, the optical module 300 and the chassis 400 therein.

Next, constitution of the display part 200 is described with reference to FIGS. 2 and 3 in detail.

Figure 2:
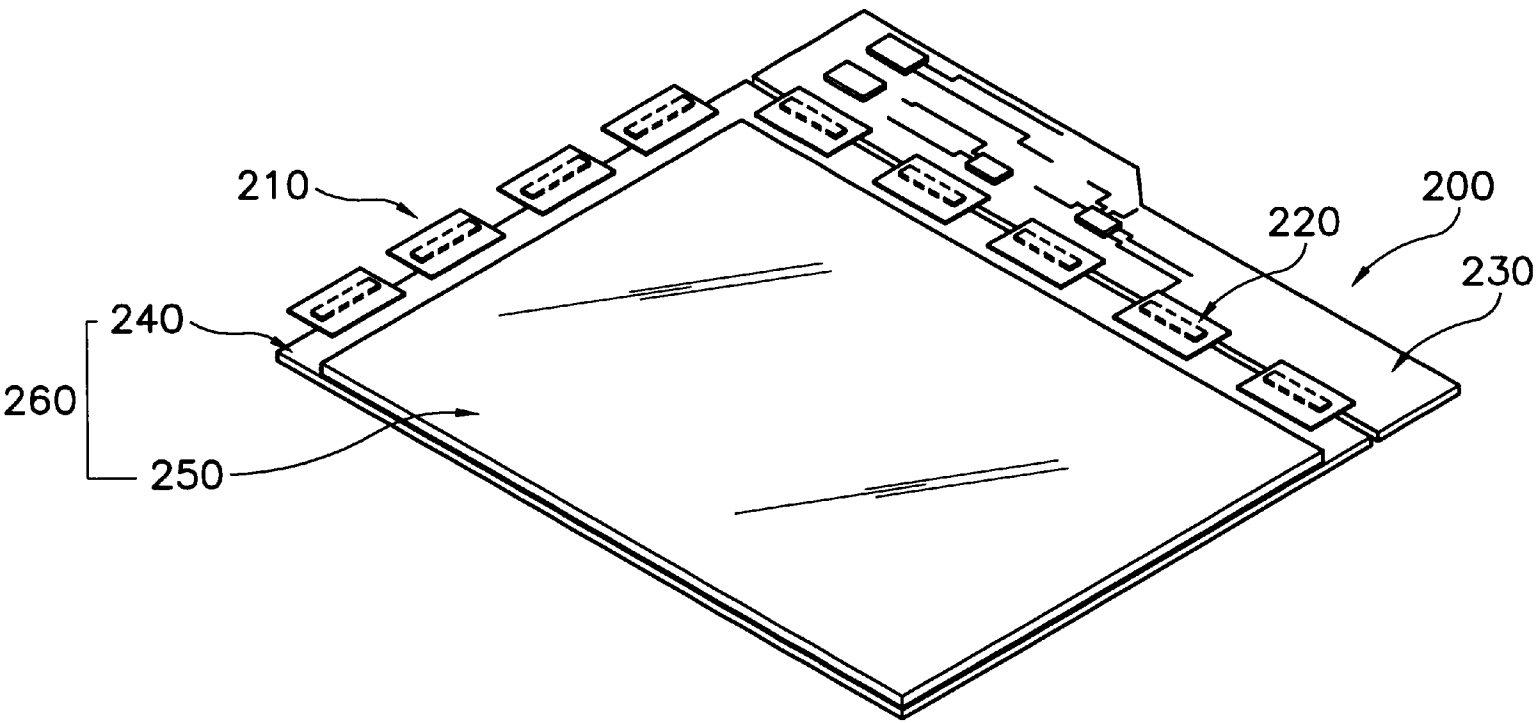
FIG. 2 is a perspective view of a display part according to a preferred embodiment of the present invention.

Referring to FIG. 2, the display part 200 includes the flexible printed circuit (FPC) 210, a tape carrier package (TCP) 220, the printed circuit board (PCB) 230 and an LCD panel 260. The LCD panel 260 includes a TFT substrate 240, a color filter substrate 250 coupled to the TFT substrate 240, and a liquid crystal (not shown) interposed between the TFT substrate 240 and the color filter substrate 250. The liquid crystal of the liquid crystal layer is injected into a space between the TFT substrate 240 and the color filter substrate 250 and then its injecting entry is sealed.

Here, the PCB 230 generates data signals, gate on/off signals and other control signals with data and control signals both input from an external information processing unit, and applies the generated signals to the TCP 220 and the FPC 210. The TCP 220 has a source drive integrated circuit (IC) mounted therein as a source signal converting section. The TCP 220 receives data signals and gray scale voltage contained in the control signals, converts them into source signals and applies the converted source signals to the LCD panel 260. The FPC 210 has a gate drive IC mounted therein as a gate signal converting section. The FPC 210 receives the gate signals and the control signals necessary for the gate signals and applies the gate on voltage and gate off voltage to the LCD panel 260.

One end of the FPC 210 is bonded to a first edge of the TFT substrate 240 and one end of the TCP 220 is bonded to a second edge adjacent and perpendicular to the first edge. Also, the other end of the TCP 220 is bonded to the PCB 260 through an electrical connection.

Figure 3:
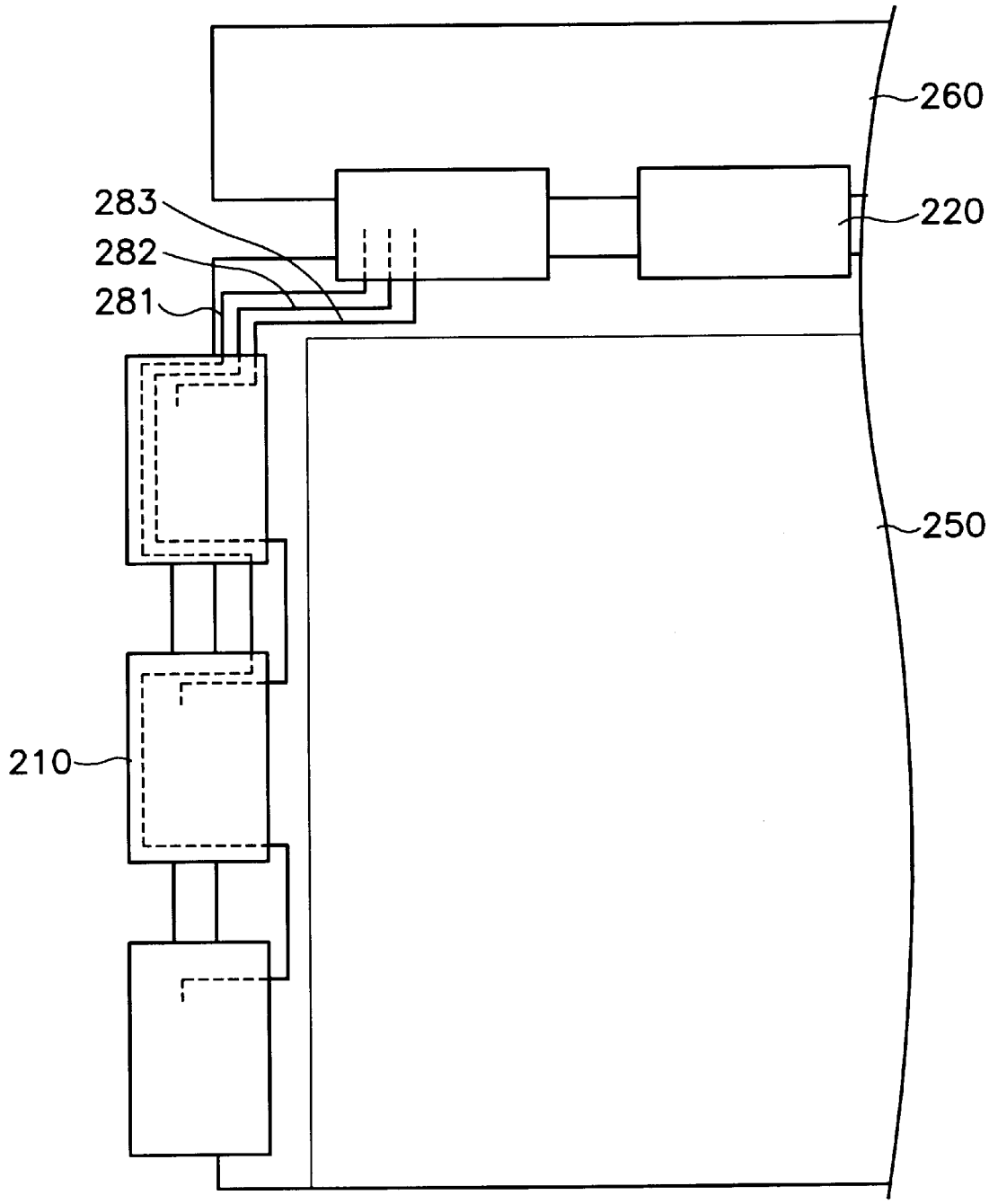
FIG. 3 is a plane view showing a part of the display part to describe a method for forming an interconnection line of the display part shown in FIG. 2.

Referring to FIG. 3, in order to electrically connect the PCB 260 with the FPC 210, there are formed conductive interconnection lines 281, 282, 283 on the TFT substrate 240. The interconnection lines 281, 282, 283 are patterned in a zigzag form on the first and second edges of the TFT substrate 240. One end of the interconnection lines 281, 282, 283 are connected to the TCP 220 and the other ends thereof are connected to the FPC 210.

Specifically, one end of the interconnection line 283 is connected to the nearest gate drive IC of the FPC 210, one end of the interconnection line 282 is connected to the gate drive IC first next to the nearest gate drive IC of the FPC 210 and one end of the interconnection line 281 is connected to the gate drive IC second next to the nearest gate drive IC of the FPC 210.

Figure 4:
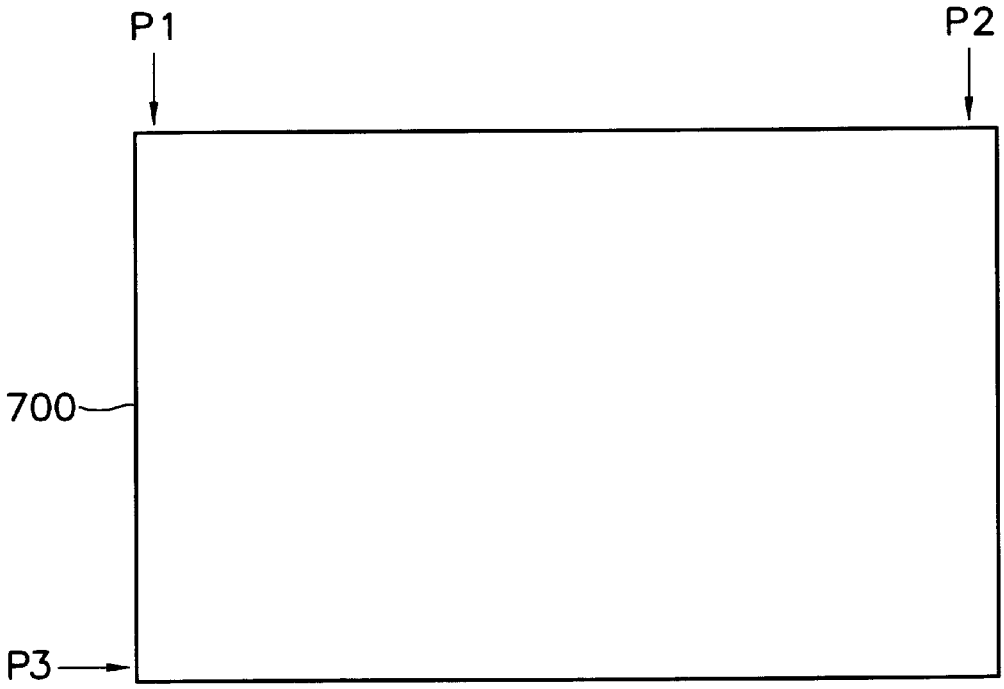
FIG. 4 is a schematic diagram showing positions of the display part where a common voltage can be applied.

The above constituted LCD applies a common electrode voltage at the positions indicated by the arrows of FIG. 4 showing an outline of an LCD panel screen 700.

In other words, the common electrode voltage can be applied at an upper left portion P1 and an upper right portion P2 of the LCD panel screen 700. Lower left portion P3 is a position where detection for feeding-back the common electrode voltage applied to the LCD panel 260 is performed.

The detection position for the feed-back is not limited to the position P3 and is variously changed into different positions, for example, either one of the first edge of the source side or the second edge of the gate side, or both edges if the selected position can be connected to the common electrode.

Figure 5:
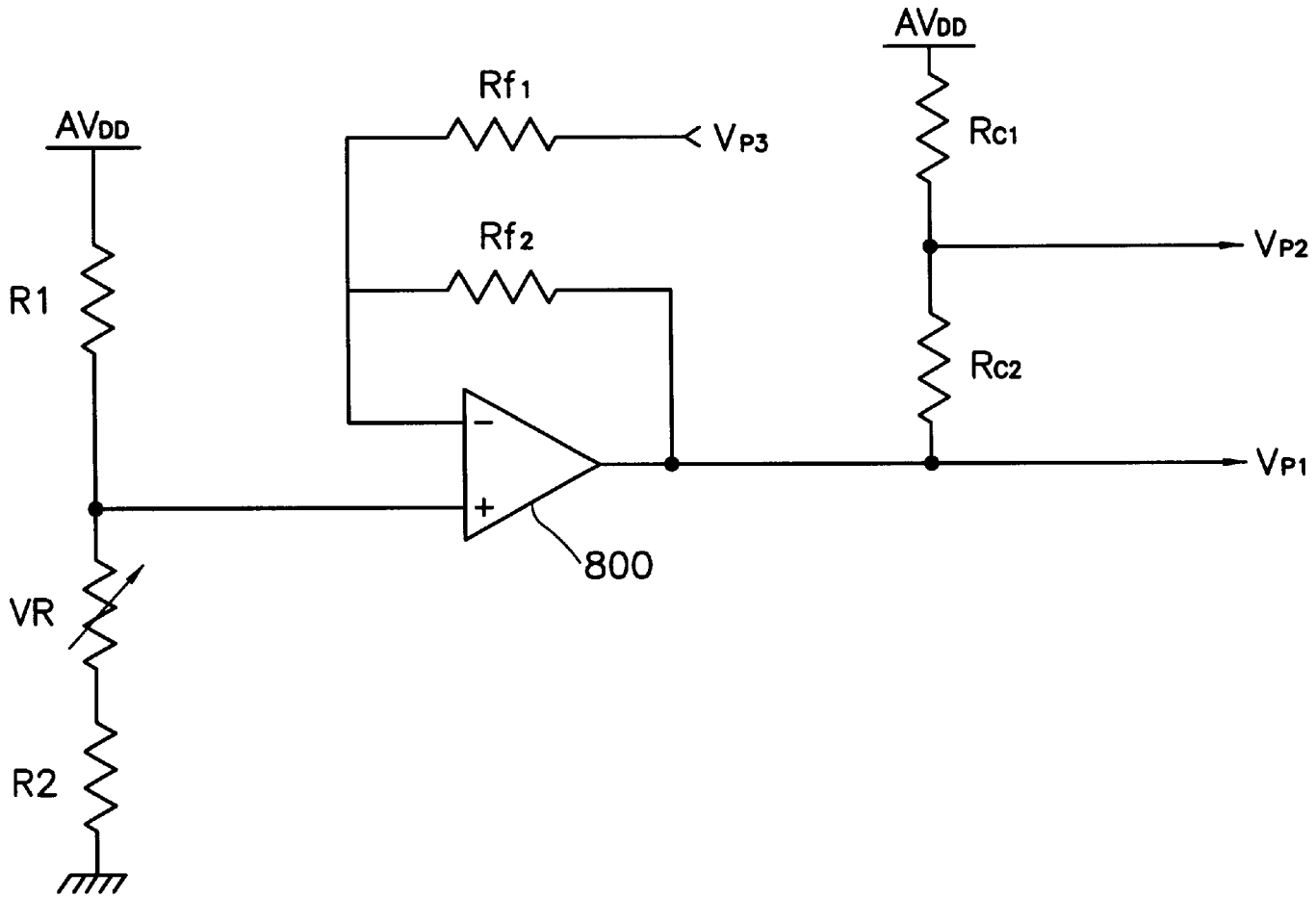
FIG. 5 is a circuit diagram showing a feed-back circuit according to a preferred embodiment of the present invention.
Figure 6:
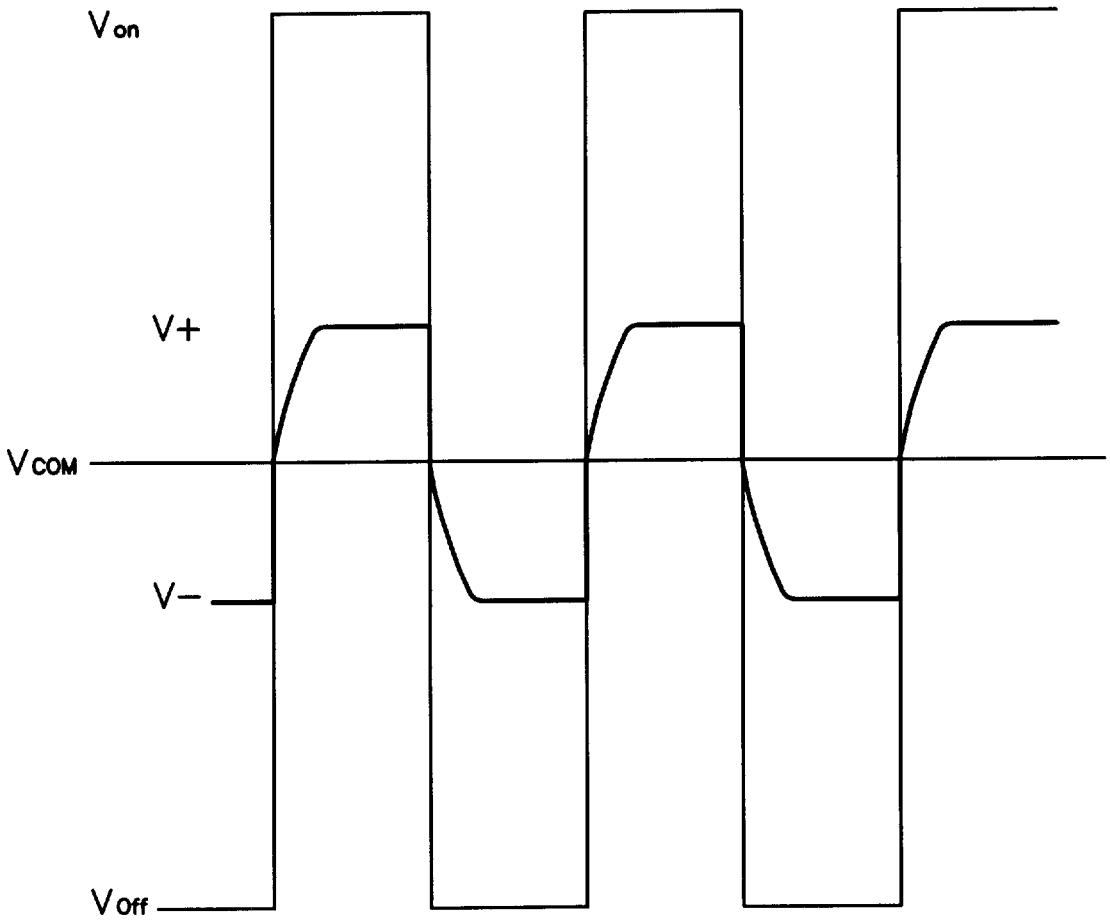
FIG. 6 is waveforms of driving signals for the liquid crystal display device according to the present invention.

As an example, when it is set that common electrode voltages Vp1 and Vp2 are applied at the upper left portion P1 and the upper right portion P2, respectively and a detection voltage for the feed-back Vp3 is applied at the left lower portion P3, the feed-back circuit can be constituted as shown in FIG. 5.

The feed-back circuit of FIG. 5 can be realized on the PCB 230 or the TCP 220, and it is desirous that the interconnection line connected to the feed-back resistance Rf1 extends to the feed-back circuit via the gate drive integrated circuits.

By the definition aforementioned, in the feed-back circuit of FIG. 5, the static voltage Avdd is divided by the resistance R1, the variable resistance VR and the resistance R2. The voltage divided by the variable resistance VR and the resistance R2 is input into the positive terminal (+) of the comparator 800. At this time, the output of the comparator 800 is applied at the upper left portion P1 as the common electrode voltage Vp1. The potential difference between the common electrode voltage Vp1 and the static voltage Avdd is divided by the resistances Rc1 and Rc2 and then applied. As a result, a static voltage Vp2 which is level-controlled voltage is applied at the upper right portion P2 as a common electrode voltage Vp2.

At this time, the output of the comparator 800 is fed-back via the feed-back resistance Rf2 to the negative terminal (−) and the fed-back output of the comparator 800 is mixed with the voltage which is detected at the left lower portion P3 of the LCD panel 260, i.e., the feed-back voltage Vp3 which is applied to the feed-back resistance Rf1.

The aforementioned feed-back circuit of FIG. 5 is provided to minimize a difference between the gate off voltages which are respectively applied to the gate drive integrated circuits.

Specifically, each unit pixel in the LCD panel 260 is supplied data signal swinging from+V to −V and gate on/off signal swinging from Von to Voff and the common electrode is supplied a common electrode voltage Vcom through the gate line and the data line.

As the data signal is applied, an alternating current (AC) flows into the gate off line and the common electrode coupled to the gate off line to generate the swing. Since the gate off line connected to each unit pixel and the common electrode are in a coupling state each other by LC capacitance, storage capacitance and parasitic capacitance, the common electrode voltage is affected on the swing of the gate off signal.

Figure 7:
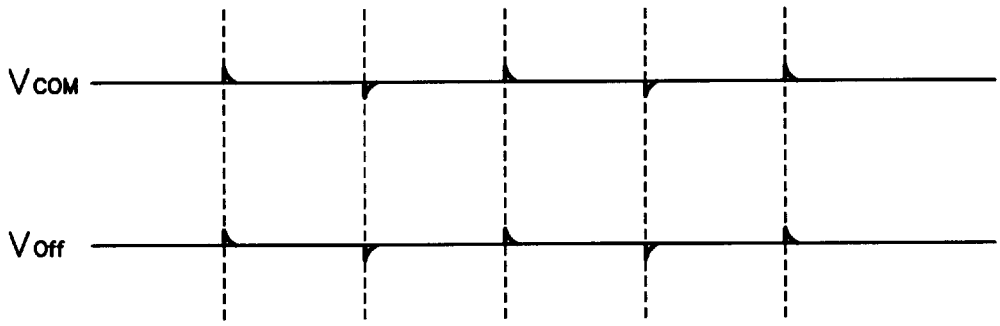
FIG. 7 is waveforms showing a relationship between the common electrode voltage and the gate off voltage.

So, as shown in FIG. 7, if the gate off voltage Voff is held at a constant level, the common electrode voltage swings in nearly the same amplitude and delay characteristic as the gate off voltage Voff.

The swing of the gate off voltage Voff has different amplitudes Voff1, Voff2, Voff3 depending on respective drive ICs when the swing is in a positive state or a negative state as shown in FIG. 8A or FIG. 8B.

Accordingly, the LCD of the present invention detects distortion of the common electrode voltage through the feed-back circuit shown in FIG. 5 and allows the voltage Vp3 corresponding to the distortion to be applied to the negative terminal of the comparator 800 through the feed-back resistance Rf1 and reference voltage which is level-divided by the resistances R1 and R2 and the variable resistance VR to be applied to the positive terminal.

The comparator 800 uses as an output a signal corresponding to a voltage difference between the positive terminal and the negative terminal. Thus, although a line at the feed-back resistance Rf1 side is open, the output of the comparator 800 is stabilized by the feed-back resistance Rf2 of the output thereof. Thereby, the common electrode voltage Vp1 is output from the output terminal of the comparator 800 and the static voltage AVdd is level-divided by the resistances Rc1 and Rc2 and then output as the common electrode voltage Vp2.

Resultantly, the output of the common electrode voltages Vp1 and Vp2 is controlled by the feed-back and current is supplied by a coupling of respective capacitance components using the controlled output of the common electrode voltage. Thus, the swing of the gate off voltage Voff is controlled, so that the amplitude difference shown in FIG. 8 does not occur.

In the above, the reference voltage of the comparator 800 is decided by voltages divided by the resistance R1, variable resistance VR and resistance R2 and the flicker can be controlled by varying the level of the reference voltage using the variable resistance VR.

If the reference voltage is decided, the comparator 800 decides its output level using feed-back voltages fed-back through the feed-back resistances Rf1 and Rf2. The decided output of the comparator 800 is output as the common electrode voltages Vp1 and Vp2.

In the constitution of the feed-back circuit, the feed-back resistance Rf1 includes resistance of the interconnection line and is representative of all resistance components connected to the feed-back loop in series. The feed-back resistance Rf2 is one to stabilize the output of the comparator 800 even when the feed-back loop through the feed-back resistance Rf1 is open and its value is preferably set 10 times greater than that of the resistance Rf1.

Also, the resistances Rc1 and Rc2 are to allow the common voltages Vp1 and Vp2 to have different values and resistance ratio of them can be varied depending on the characteristics of the LCD panel. As applied to a real panel, the resistance Rc1 is set 100Ω or less to have a sufficient margin to gate block.

Figure 8:
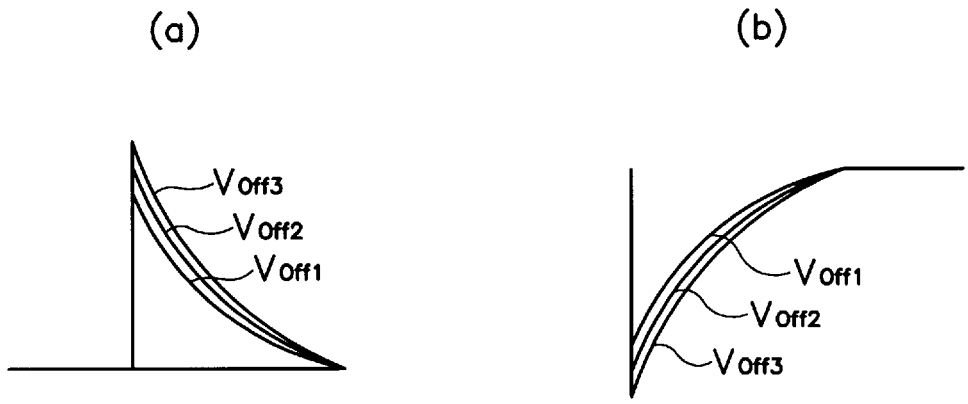
FIGS. 8A and 8B are waveforms showing variation of the gate off voltage every gate ICs when the common electrode voltage is positive and negative, respectively.

As described above, if the common electrode voltages Vp1 and Vp2 are stabilized, the gate off voltage coupled by various capacitor components shows the same behavior as the common electrode voltage, so that the amplitude difference shown in FIG. 8 followed by the delay characteristics between the gate drive integrated circuits is compensated.

Thus, the amplitude of the gate off signal applied to every gate drive IC of the display part becomes identical, so that a difference in brightness is generated, to thereby prevent the picture from being made in a block shape.

As described previously, the present invention can prevent a difference in brightness of a picture displayed on the LCD panel screen from being generated by corresponding gate drive ICs. As a result, a clean and desired picture can be displayed and thus product reliability is enhanced.

While the present invention has been described in detail, it should be understood that various changes, substitutions and alterations can be made hereto without departing from the spirit and scope of the invention as defined by the appended claims.

What is claimed is:

1. A liquid crystal display device, comprising:

an optical module that provides a light to form an image;

a display part that displays the image by controlling a transmittance amount of the light provided from the optical module; and a receiving part that receives and fixes the optical module and the display part, wherein the display part comprises:

an LCD panel;

a PCB that provides a data signal, a gate on/off signal, a common electrode voltage, and first plural control signals to operate the LCD panel;

a source signal converter that generates a source signal with the data signal and a second control signal contained in the first plural control signals, and applies the source signal to the LCD panel; and a gate signal converter that generates the gate on signal and gate off signal with the gate on/off signal and a third control signal contained in the first plural control signals, and applies the gate on signal and gate off signal to the LCD panel; and a gate voltage stabilizer, comprising:

a first feed-back voltage detector that detects a common electrode voltage corresponding to a first feed-back voltage from at least one position, wherein the first feed-back voltage detector includes a feed-back resistor;

a reference voltage provider that controls a static voltage as a reference voltage within a predetermined voltage level;

a comparator having a positive terminal electrically connected to the reference voltage provider capable of receiving the reference voltage and a negative terminal electrically connected to the first feed-back voltage detector capable of receiving the first feed-back voltage from the first feed-back voltage detector, wherein the comparator compares the first feed-back voltage with the reference voltage and outputs a compared result and the comparator comprises a loop including a second feed-back resistor in which the output of the comparator is mixed with the first feed-back voltage and then is fed-back to the comparator such that the comparator stabilizes an output of the comparator; and a divider electrically connected to an output terminal of the comparator capable of receiving a result outputted from the comparator, wherein the divider divides the result outputted from the comparator into at least two voltages having different voltage levels from each other and applying at least one of the two voltages to a common electrode of the LCD panel.

2. The liquid crystal display device of claim 1, wherein the loop has the second feed-back resistor having a resistance of about eight times to about twelve times greater than that of the first feed-back resistor of the feed-back voltage detector.

3. The liquid crystal display device of claim 1, wherein the reference voltage provider comprises plural resistors connected in series to which a static voltage is applied, and a variable resistor, wherein flicker of the display is controlled by controlling a resistance of the variable resistor.

4. The liquid crystal display device of claim 1, wherein the divider comprises resistors connected in series.

5. The liquid crystal display device of claim 1, wherein the common electrode voltage is detected at a gate side.

6. The liquid crystal display device of claim 5, wherein the common electrode voltage is detected at a position corresponding to a last gate driver IC of the gate side.

7. The liquid crystal display device of claim 1, wherein the common electrode voltage is detected at a source side.

8. A gate voltage stabilizer that detects a common electrode voltage from at least one position and controls the common electrode voltage by feeding back the detected common electrode voltage so as to maintain an amplitude of a gate off voltage at a substantially constant level, the gate voltage stabilizer, comprising:

a first feed-back voltage detector that detects the common electrode voltage corresponding to a first feed-back voltage from at least one position, wherein the first feed-back voltage detector has a feed-back resistor;

a reference voltage provider that controls a static voltage as a reference voltage within a predetermined voltage level;

a comparator having a positive terminal and a negative terminal, wherein the positive terminal is electrically connected to the reference voltage provider in order to receive the reference voltage and the negative terminal is electrically connected to a second feed-back resistor and to the first feed-back voltage detector in order to receive the first feed-back voltage from the first feed back voltage detector and the comparator compares the first feed-back voltage with the reference voltage and outputs a result obtained from the comparing; and a divider that is electrically connected to an output terminal of the comparator which is capable of receiving the output from the comparator, wherein the divider divides the output from the comparator into at least two voltages having different voltage levels from each other and applies the divided voltages to a common voltage of the LCD panel.

9. The gate voltage stabilizer of claim 8, wherein the comparator comprises a loop in which an output is mixed with the first feed-back voltage and then is fed-back to the second feed-back resistor through the comparator such that the loop stabilizes an output of the comparator.

10. The gate voltage stabilizer of claim 9, wherein the loop has the second feed-back resistor having a resistance of about eight times to about twelve times greater than that of the feed-back resistor in the first feed-back voltage detector.

11. The gate voltage stabilizer of claim 8, wherein the reference voltage provider comprises plural resistors connected in series to which a static voltage is applied, a variable resistor, wherein flicker of the display is controlled by controlling a resistance of the variable resistor.

12. The gate voltage stabilizer of claim 8, wherein the divider comprises resistors connected in series.

13. The gate voltage stabilizer of claim 8, wherein the common electrode voltage is detected at a gate side.

14. The gate voltage stabilizer of claim 13, wherein the common electrode voltage is detected at a position corresponding to a last gate driver IC of the gate side.

15. The gate voltage stabilizer of claim 8, wherein the common electrode voltage is detected at a source side.

16. A display part of a liquid crystal display device, comprising:

an LCD panel;

a PCB which generates a data signal, a gate on/off signal, a common electrode voltage, and plural control signals to the LCD panel;

a gate voltage stabilizer comprising a feed-back voltage detector that detects a common electrode voltage corresponding to a feed-back voltage from at least one position, wherein the feed-back voltage detector includes a feed-back resistor; and a comparator having a positive terminal electrically connected to a reference voltage provider and a negative terminal electrically connected to the feed-back voltage, wherein the comparator compares the first feed-back voltage with the reference voltage and generates an output signal, and wherein the comparator further comprises a loop including a second feed-back resistor in which the output of the comparator is mixed with the feed-back voltage and then is fed-back to the comparator such that the comparator stabilizes the output signal.

17. The display part of a liquid crystal display device of claim 16, wherein the gate voltages stabilizer further comprising a divider means for dividing the output signal from the comparator into at least two voltages having different voltage levels from each other and applying the divided voltages to a common voltage of the flat panel.

* * * * *